United States Patent [19]

Matsumoto et al.

[11] 4,194,730

[45] Mar. 25, 1980

[54] MOLTEN METAL HANDLING VESSELS

[75] Inventors: Chiaki Matsumoto, Akashi; Hirokatsu Imai, Amagasaki; Masaru Okawa, Ashiyashi, all of Japan

[73] Assignee: Foseco Trading AG, Chur, Switzerland

[21] Appl. No.: 858,476

[22] Filed: Dec. 27, 1977

[51] Int. Cl.[2] ..... C21C 7/00

[52] U.S. Cl. ..... 266/275; 266/280

[58] Field of Search ..... 266/275, 278, 280, 281, 266/283, 286

[56] References Cited

U.S. PATENT DOCUMENTS

| | | | |
|---|---|---|---|
| 3,764,125 | 10/1973 | Horn et al. | 266/280 |
| 4,012,029 | 3/1977 | Seguin et al. | 266/275 |
| 4,042,229 | 8/1977 | Eccleston | 266/275 |
| 4,043,543 | 8/1977 | Courtenay et al. | 266/275 |
| 4,055,336 | 10/1977 | Massin | 266/275 |
| 4,076,224 | 2/1978 | Duchateau | 266/275 |
| 4,126,301 | 11/1978 | Massin | 266/280 |

FOREIGN PATENT DOCUMENTS

| | | | |
|---|---|---|---|
| 1506506 | 5/1978 | United Kingdom | 266/280 |

*Primary Examiner*—L. Dewayne Rutledge
*Assistant Examiner*—Peter K. Skiff
*Attorney, Agent, or Firm*—Cushman, Darby & Cushman

[57] ABSTRACT

Molten metal handling vessels e.g. tundishes consist of an outer metal casing, a relatively permanent refractory lining and an inner disposible lining made of a plurality of slabs of refractory heat insulating material. Channels formed in the permanent lining adjacent the joints between the slabs or by rebates in the slabs are filled with refractory material, either preformed shapes or a refractory composition filled in situ. Such refractory material minimizes steel penetration through the joints between the slabs. The refractory material may contain carbonaceous material to enhance this antipenetration property.

24 Claims, 4 Drawing Figures

MOLTEN METAL HANDLING VESSELS

This invention relates to molten metal handling vessels. It is of particular value in the construction and operation of tundishes used in continuous casting and it will be specifically described with reference to that use. However, the present invention is of value in other molten metal handling vessels such as ladles and launders.

Vessels for containing molten metal usually consist of a metal casing lined with one or more inner layers of refractory bricks or with one or more layers of refractory concrete. Lining such metal casings to produce vessels in which molten metals may be held or through which molten metals may be passed is time consuming and expensive, and additionally demands skilled bricklaying if it is to be successfully carried out. Damage to such linings can occur during use and when this happens the vessel must be taken out of service and at least the damaged areas relined. Relining is a difficult operation to carry out, even where only small areas of the lining need to be repaired.

Accordingly in recent years attempts have been made to minimise relining and rebricking and one of the most successful developments has been the use of expendable inner linings. Such expendable linings are formed of a material sufficiently refractory and mechanically resistant to stand up to use for a relatively short period of time, for example one continuous casting cycle in the case of a tundish. At the end of such time, the vessel is emptied and thereafter the expendable lining is removed and discarded together with any residues of molten metal left behind, socalled "skull". The expendable lining serves to protect the underlying refractory brick or refractory concrete lining and as a result this relatively permanent lining has a much longer service life. Expendable linings which are generally made up of a relatively small number of slabs or tiles of refractory heat insulating material are straightforward to install, and require considerably less time to install than would be required if the vesel had to be reparied by rebricking or partial or total relining with refractory concrete.

British Pat. No. 1,364,665 describes a tundish consisting of a metal casing having a relatively permanent refractory lining and an inner expendable lining which is thrown away at the end of each casting cycle. British Pat. No. 1,469,513 describes a tundish likewise using an expendable lining in which there is interposed between the slabs forming the expendable lining and the relatively permanent lining a layer of loose fill refractory material, e.g. sand. Such a loose fill refractory helps to support the inner expendable lining evenly and additionally helps to seal the joints between the individual lining slabs and prevent molten metal penetrating to the permanent lining. However, such loose fill refractory material can cause difficulties if it becomes included in the molten metal being cast. Suggestions which have been made and which may be used to minimise the risk of sand penetration into the cavity of the tundish include forming the joint edges of the slabs in castellated fashion so that when interlocked the loose fill particulate refractory material cannot fall into the central cavity. Such a system is described in German Offenlegungsschrift No. 2,651,295. An alternative approach is to provide a leaf seal at the edge of one of the slabs at each joint between two slabs.

All of these suggestions and proposals, although effective, require the presence of relatively large quantities of sand which carries the risk of inclusion in the metal being cast and in addition increases the overall weight of the tundish.

According to the present invention there is provided a vessel for containing molten metal comprising an outer metal casing, a relatively permanent lining of refractory material adjacent the casing and adjacent the relatively permanent lining an inner expendable lining made up of a plurality of slabs of refractory heat insulating material wherein behind at least some of the joints between adjacent slabs of refractory heat insulating material channels are formed, which channels are filled with refractory material.

The channels may be formed either in the relatively permanent lining itself or by rebating the edges of the slabs adjacent the joint on the face remote from the interior of the vessel. When such rebated slabs are assembled together the two rebates form a channel behind the joint between slabs and between them and the relatively permanent lining. The channels may also be formed by a combination of such rebates on the slabs and a channel in the relatively permanent lining.

Not all of the joints between the slabs forming the expendable lining need to have an associated channel; for example channels may be provided adjacent only some or all of the joints between the wall slabs and not adjacent those between the floor slabs, or adjacent all the joints.

As noted above, the channels are filled with refractory material. A wide variety of refractory materials may be used to fill the channels and they may be filled with such material in bonded or unbonded form. Thus the channels may be filled with a loose fill of particulate refractory material or with preformed shapes made of refractory heat insulating material or with a filling formed of a mouldable material which when set is refractory. The material of the filling may be based on any particulate refractory material used in the manufacture of steelworks refractories, for example silica, alumina, magnesia, zirconia, various refractory silicates and material such as grog, mullite, sillimanite, olivine and zircon. The material may also consist of or include a portion of a carbonaceous refractory material, for example, particulate graphite.

Thus the channels may be filled for example with preformed shapes such as strips of a refractory composition comprising a particulate refractory material such as silica sand, alumina, magnesia or chamotte bonded with a binder such as phenolformaldehyde resin, a unreaformaldehyde resin or sodium silicate. The composition may, if desired, include fibrous materials such as organic fibre e.g. waste paper pulp or inorganic fibre e.g. asbestos, slag wool or alumino silicate fibre in order to improve the strength thereof. A typical composition for such refractory strips is 70 to 97% by weight particulate refractory material, 3 to 10% by weight binder and 0 to 20% by weight fibre.

If desired the preferred shapes and the slabs of the inner expendable lining may be made from the same material.

Another material which may be used to fill the channels is a castable or rammable refractory mix comprising particulate refractory materials such as chamotte or silica sand, particulate carbonaceous material such as graphite, coke or carbon black and a binder, for example aqueous sodium silicate. Carbon containing fillers for the channels are particularly preferred because of the non-wetting properties of carbonaceous refractories. This helps inhibit penetration by molten steel in use.

Molten metal containing vessels according to the present invention may be assembled by any convenient method. The first step is to provide the metal casing with an appropriate refractory lining either by bricking or by casting a lining in situ. If the channels are to be provided in the relatively permanent lining, this may be effected easily in the case of castable linings by providing a number of projections on the pattern which is inserted into the casing to define the casting space. When the pattern is removed, channels remain in the face of the cast relatively permanent lining where the projections were present on the pattern. Thereafter, if preformed refractory strips are to be used to line the channels they may be inserted prior to the installation of the expendable lining slabs. Otherwise, the expendable lining slabs are next installed and thereafter the channels filled e.g. with loose fill or rammable or castable refractory material. Preformed strips may also be inserted after assembly of the expendable lining.

If desired some or all of the joints between the slabs constituting the expendable lining may be sealed with a refractory mortar but it is possible in some cases to avoid the necessity for doing so, particularly if use is made of one of the dry jointing systems described above e.g. castellated edges to the slabs or leaf seals on the edge of the slabs.

The slabs constituting the expendable lining may be made of refractory heat insulating compositions known for the purpose and which are described in some detail in the above mentioned specifications. Generally the slabs will have a composition consisting predominantly of particulate refractory material, part of which may be carbonaceous, a fibrous material, usually mostly or wholly of inorganic fibre, and a binding agent.

In the use of the molten metal containing vessels according to the present invention, all the advantages of the use of an expendable lining as explained in the specifications noted above are retained. Additionally, there is even less tendency to permanent damage to the relatively permanent lining than before because the weak points in the expendable lining, i.e. the joints between the slabs constituting the expendable lining are backed up by the channels filled with refractory material. Thus, the difficulty of molten metal penetration between the joints of the slabs of the expendable lining which can be encountered in tundishes during long continuous casting runs can be substantially or wholly avoided by using a tundish constructed according to the present invention. Even if the joints do become penetrated, steel and slag penetration is usually restricted to the area of the channel. The refractory material in the channel is removed when the expendable lining is removed e.g. at the end of a continuous casting cycle.

The present invention is illustrated by way of example with reference to the accompanying drawings, in which.

Figure 1:
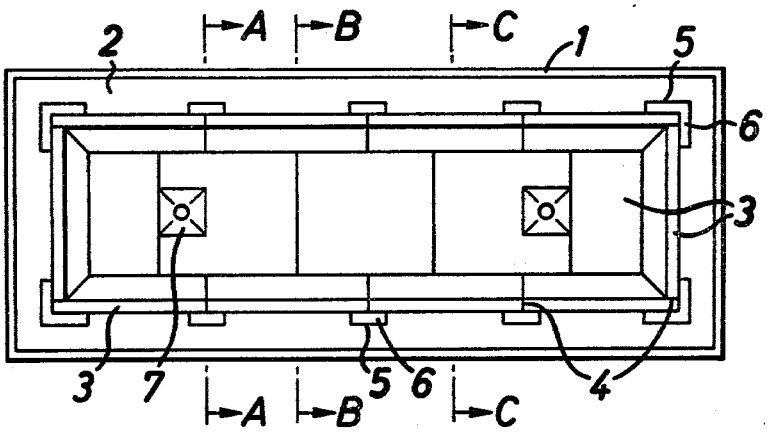
FIG. 1 is a plan view of a tundish.
Figure 2:
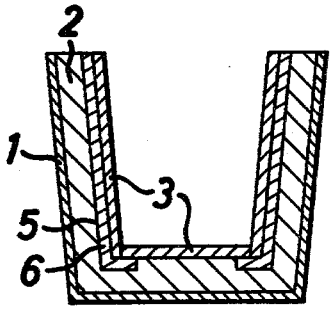
FIG. 2 is a cross section of the tundish along the lines AA in FIG. 1.
Figure 3:
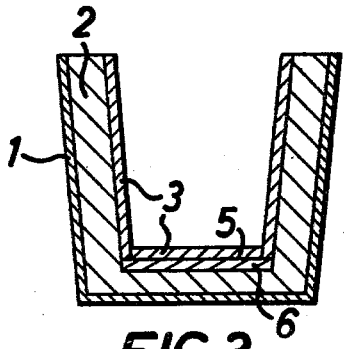
FIG. 3 is a cross section of the tundish along the lines BB in FIG. 1.
Figure 4:
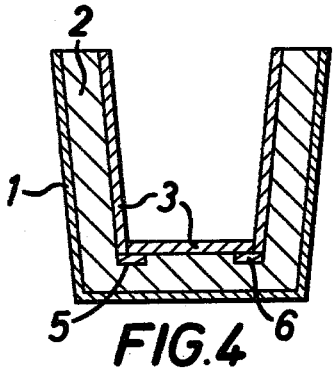
FIG. 4 is a cross section along the lines CC in FIG. 1.

Referring to the drawings the tundish there shown consists of an outer metal casing 1 which is lined with a relatively permanent refractory lining 2. Set inside the relatively permanent lining is an expendable lining made up of a set of slabs 3 of refractory heat insulating material. Joints 4 between slabs 3 are each associated with channels 5 formed in the relatively permanent lining of the tundish. The channels 5 are filled with refractory material 6 of any of the types noted above. Two casting nozzles 7 are set in the base of the tundish in known fashion.

In the tundish illustrated, there is a channel 5 associated with each joint 4 between the tundish lining slabs. It should be appreciated however that there is no necessity to have a channel 5 associated with each such joint.

The following examples will serve to illustrate the invention:

EXAMPLE 1

A tundish substantially as shown in the accompanying drawings was formed by lining a metal casing with a refractory concrete relatively permanent lining by casting refractory concrete round a pattern which had been inserted into the metal casing. The pattern had projections corresponding to the channels 5 and after removal of the core the channels left in the relatively permanent lining were each 20 mm deep and 120 mm in width. Each part of the angled channel at the corner of the tundish was 120 mm wide.

The so formed channels were then filled on one side and at two corners of the tundish with preformed bonded graphite shapes and on the other side of the tundish and at the other two corners filled with a rammable refractory mix of a composition comprising particulate refractory material, graphite powder and sodium silicate. This mixture could be trowelled into place to fill the channels.

An expendable lining was then installed, each lining slab being 30 mm thick and of composition by weight 92% silica sand, 4% refractory fibre, 3% organic binder and 1% inorganic binder.

The tundish so made was of 4 tonnes capacity and was used to cast plain carbon steel (carbon content 0.1%) from five successive 40 tonne ladles. Casting lasted for about 7 hours. Prior to casting, the two nozzles 7 only were preheated for about 20 minutes using gas burners from the outside.

Casting was carried out satisfactorily throughout the whole of the 7 hour period without tendency to nozzle blockage. At the end of casting, the expendable lining and skull were easily removed and the refractory material in the cavities 5 was removed at the same time. The relatively permanent refractory lining of the tundish was undamaged.

EXAMPLE 2

Example 1was repeated on an identical tundish casing with the following changes:

The relatively permanent lining was cast with channels 100 mm wide by 30 mm deep rather than 120 mm wide and 20 mm deep and the dimensions of the channels at the corners of the tundish were altered in like fashion. The expendable lining slabs were inserted before channels 5 were filled and the joints between them covered over with 0.6 mm thickness steel strips, these strips being nailed to the lining slabs 3. Channels 5 were thereafter filled with loose silica sand.

Similar excellent results to Example 1 were also obtained.

EXAMPLE 3

A relatively permanent lining was cast into a metal tundish casing with projections on the pattern inserted into the casing so that after removal of the pattern the relatively permanent lining had channels 5 thereon of width 120 mm and depth 30 mm along the sides of the tundish and of 100 mm width by 30 mm depth in each part of the L-shaped channel at the corner of the cavities.

Preformed strips of a composition comprising by weight silica sand 95%, paper pulp 1%, phenolic resin 4% were then fitted into each of the channels.

An expendable lining was then inserted made up of a set of 30 mm thick slabs of the same composition as those used in Example 1.

The tundish so made was of 4 tonnes capacity and was used in continuous casting under the same conditions as set out in Example 1. Similar very satisfactory results were obtained and no damage to the relatively permanent lining was observed after the expendable lining had been removed.

We claim:

1. In a vessel for containing molten metal comprising an outer metal casing, a relatively permanent lining of refractory material adjacent the casing and adjacent the relatively permanent lining an inner expendable lining made up of a plurality of slabs of refractory heat insulating material, the improvement comprising, behind at least some of the joints between adjacent slabs of refractory heat insulating material, channels filled with a cast refractory composition.

2. The vessel of claim 1 wherein the channels are formed in the relatively permanent lining.

3. The vessel of claim 1 wherein the channels are formed by rebating the edges of the slabs adjacent the joint on the face remote from the interior of the vessel.

4. The vessel of claim 1 wherein the joints between the slabs of the expendable lining are additionally covered by a sealing strip.

5. The vessel of claim 1 which is a tundish.

6. The vessel of claim 1 wherein the refractory material comprises a proportion of carbonaceous refractory material.

7. The vessel of claim 6 wherein the carbonaceous particulate refractory material is graphite.

8. In a vessel for containing molten metal comprising an outer metal casing, a relatively permanent lining of refractory material adjacent the casing and adjacent the relatively permanent lining an inner expendable lining made up of a plurality of slabs of refractory heat insulating material, the improvement comprising, behind at least some of the joints between adjacent slabs of refractory heat insulating materials, channels filled with a rammed refractory composition.

9. The vessel of claim 8 wherein the channels are formed in the relatively permanent lining.

10. The vessel of claim 8 wherein the channels are formed by rebating the edges of the slabs adjacent the joint on the face remote from the interior of the vessel.

11. The vessel of claim 8 wherein the joints between the slabs of the expendable lining are additionally covered by a sealing strip.

12. The vessel of claim 8 which is a tundish.

13. The vessel of claim 13 wherein the refractory material comprises a proportion of carbonaceous refractory material.

14. The vessel of claim 13 wherein the carbonaceous particulate refractory material is graphite.

15. In a vessel for containing molten metal comprising an outer metal casing, a relatively permanent lining of refractory material adjacent the casing and adjacent the relatively permanent lining an inner expendable lining made up of a plurality of slabs of refractory heat insulating material, the improvement comprising, behind at least some of the joints between adjacent slabs of refractory heat insulating material, channels filled with preformed shapes of bonded refractory material.

16. The vessel of claim 15 wherein the channels are formed in the relatively permanent lining.

17. The vessel of claim 15 wherein the channels are formed by rebating the edges of the slabs adjacent the joint on the face remote from the interior of the vessel.

18. The vessel of claim 15 wherein the joints between the slabs of the expendable lining are additionally covered by a sealing strip.

19. The vessel of claim 15 which is a tundish.

20. The vessel of claim 15 wherein the preformed shapes and the slabs are made from the same material.

21. The vessel of claim 20 wherein the refractory material comprises a proportion of carbonaceous refractory material.

22. The vessel of claim 21 wherein the carbonaceous particulate refractory material is graphite.

23. The vessel of claim 15 wherein the refractory material comprises a proportion of carbonaceous refractory material.

24. The vessel of claim 23 wherein the carbonaceous particulate refractory material is graphite.

* * * * *